US005933691A

United States Patent [19]

Johroku

[11] Patent Number: 5,933,691

[45] Date of Patent: Aug. 3, 1999

[54] TONER SUPPLY CARTRIDGE HAVING A SHUTTER EQUIPPED TO COOPERATE WITH A STOPPER ELEMENT AND A RETURNER ELEMENT OF A GUIDE TO CLOSE THE SHUTTER AUTOMATICALLY, AND TONER SUPPLYING APPARATUS WITH SUCH CARTRIDGE

[75] Inventor: Kazuo Johroku, Osaka, Japan

[73] Assignee: Mita Industrial Co., Ltd., Osaka, Japan

[21] Appl. No.: 08/933,846

[22] Filed: Sep. 19, 1997

[30] Foreign Application Priority Data

Nov. 13, 1996 [JP] Japan ..... 8-302165

[51] Int. Cl.[6] ..... G03G 15/08

[52] U.S. Cl. ..... 399/262; 222/DIG. 1

[58] Field of Search ..... 399/262, 120, 399/258, 263; 222/DIG. 1

[56] References Cited

U.S. PATENT DOCUMENTS

| | | | |
|---|---|---|---|
| 4,878,091 | 10/1989 | Morita et al. . | |
| 5,040,025 | 8/1991 | Fukuchi | 399/262 |
| 5,074,344 | 12/1991 | Vecek et al. | 222/DIG. 1 |
| 5,089,854 | 2/1992 | Kaieda et al. | 399/262 |
| 5,737,675 | 4/1998 | Okada et al. | 399/258 |
| 5,842,093 | 11/1998 | Tanda | 399/263 |

FOREIGN PATENT DOCUMENTS

| | | |
|---|---|---|
| 578340 | 1/1994 | European Pat. Off. . |
| 757301 | 2/1997 | European Pat. Off. . |
| 63-032574 | 2/1988 | Japan . |

OTHER PUBLICATIONS

Johnson, et al., Spring Latching Mechanism For Dry ink Bottle Lid, *Xerox Disclosure Journal*, vol. 19, No. 4 Jul./Aug. 1994, pp. 303–306.

Head, Dry Ink Bottle Cap Latching Mechanism, *Xerox Disclosure Journal*, vol. 20 No. 6 Nov./Dec. 1995, pp. 513–515.

*Primary Examiner*—Arthur T. Grimley
*Assistant Examiner*—Quana Grainger
*Attorney, Agent, or Firm*—Smith, Gambrell & Russell; Beveridge, DeGrandi, Weilacher & Young

[57] ABSTRACT

A toner cartridge according to the present invention ensures easy replacement thereof and assuredly prevents a user from failing to claim its toner fall aperture. When a shutter is located in a position where the toner fall aperture is closed, a claw of a lock portion does not project outward. When the toner cartridge is inserted in an insertion direction, a right holding portion of the shutter abuts against an engagement side wall of an engagement portion, and prohibits the shutter from moving in the direction of the insertion so that the toner fall aperture is opened. When the toner cartridge is withdrawn, the lock portion of the claw is locked to a return portion provided on a side wall thereby to prohibit the shutter from moving in a direction opposite to the insertion direction. Thus, the shutter is slid in the insertion direction with respect to a flange to close the toner fall aperture.

8 Claims, 6 Drawing Sheets

55(30)
55
56
57
60
62
64
66
67
68
72
75
77
78
82
A
C

TONER SUPPLY CARTRIDGE HAVING A SHUTTER EQUIPPED TO COOPERATE WITH A STOPPER ELEMENT AND A RETURNER ELEMENT OF A GUIDE TO CLOSE THE SHUTTER AUTOMATICALLY, AND TONER SUPPLYING APPARATUS WITH SUCH CARTRIDGE

This application is based on an application No. 8-302165 filed in Japan, the content of which is incorporated hereinto by reference.

BACKGROUND OF THE INVENTION

1. Field of the Invention

The present invention relates to a toner supply cartridge for use in an image forming apparatus such as a copying machine, a facsimile machine or a printer.

2. Prior Art

A toner supply cartridge typically includes a cartridge body which contains toner therein and has a toner fall aperture formed in the bottom face thereof. The toner fall aperture is closed with a slidable shutter.

The toner supply cartridge is replaced when little toner remains in a hopper provided in a developer unit of an image forming apparatus. After the cartridge body of a new toner supply cartridge is set on the hopper, the shutter closing the toner fall aperture of the cartridge is slid so that the toner fall aperture is opened. Thus, toner inside the cartridge body falls into the hopper from the toner fall aperture thereby to be supplied into the developer unit.

The replacement of the toner supply cartridge requires a two-step procedure including the steps of: removing the used toner supply cartridge from the image forming apparatus and then setting a new toner supply cartridge in the image forming apparatus; and sliding the shutter of the new toner supply cartridge. This procedure for the replacement of the toner supply cartridge is troublesome for a user unfamiliar with the cartridge replacement.

Further, if the user forgets to close the toner fall aperture with the shutter when the used toner supply cartridge is removed from the image forming apparatus, residual toner adhering on the interior of the cartridge body falls from the toner fall aperture and scatters around.

It is therefore an object of the present invention to solve the aforesaid technical problems, and to provide a toner supply cartridge which ensures easy replacement thereof and assuredly prevents a user from failing to close its toner fall aperture.

SUMMARY OF THE INVENTION

In accordance with one aspect of the present invention, there is provided a toner supply cartridge for use in an image forming apparatus such as a copying machine, a facsimile machine or a printer, which comprises a cartridge body containing toner therein and having a toner fall aperture formed in an under face thereof, a shutter provided in association with the toner fall aperture and adapted to be slidably shifted between a closed position where the toner fall aperture is closed and an open position where the toner fall aperture is opened, and a claw provided on the shutter, the claw being in an unlockable state when the shutter is located in the closed position and in a lockable state when the shutter is located in the open position.

In accordance with another aspect of the present invention, a flange is provided around the toner fall aperture to project horizontally therefrom, and the shutter is provided slidably with respect to the flange.

In accordance with still further another aspect of the present invention, the flange is formed with a cut-away portion, and one part of the claw is fitted in the cut-away portion and the other part of the claw is in the unlockable state when the shutter is located in the closed position.

In accordance with still another aspect of the present invention, the one part of the claw is guided away from the cut-away portion to a side face of the flange and the other part of the claw is in the lockable state when the shutter is located in the open position.

In accordance with a further aspect of the present invention, the claw is formed of a resin integrally with the shutter.

In accordance with still another aspect of the present invention, the toner supply cartridge includes a guide for guiding the cartridge body, the guide having a shutter shift prohibiting portion which, when the cartridge body is inserted into the image forming apparatus to be set in a predetermined position, prohibits the shutter from being shifted but permits the cartridge body to be moved, and then shifts the shutter from the closed position to the open position.

In accordance with still a further aspect of the present invention, the guide includes a return portion for returning the shutter from the open position to the closed position with the claw in the lockable state being kept locked when the cartridge body is withdrawn from the image forming apparatus.

In accordance with the present invention, when the toner supply cartridge is set, the shutter is automatically shifted to the open position simply by inserting the toner supply cartridge along the guide in a predetermined insertion direction. Therefore, even a user unfamiliar with the cartridge replacement can readily set the toner supply cartridge without any trouble.

When the toner supply cartridge is to be removed, the shutter is automatically shifted to the closed position simply by withdrawing the toner supply cartridge in a direction opposite to the insertion direction. Therefore, the user does not have to intentionally close the toner fall aperture by sliding the shutter, and still not fail to close the toner fall aperture.

These objects and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
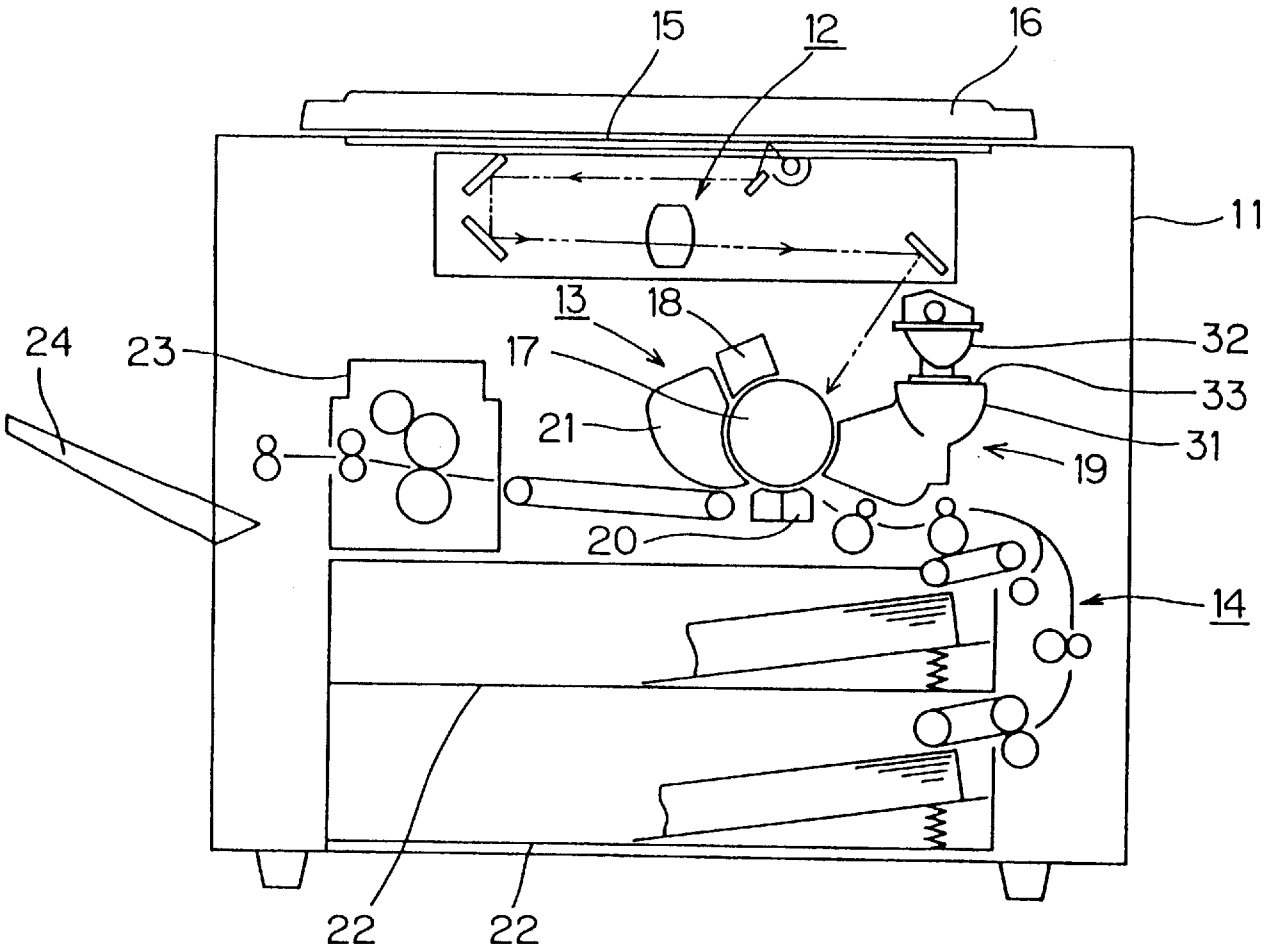
FIG. 1 is a sectional view schematically illustrating the internal construction of a copying machine in which a toner supply cartridge according to one embodiment of the present invention is set.
Figure 2:
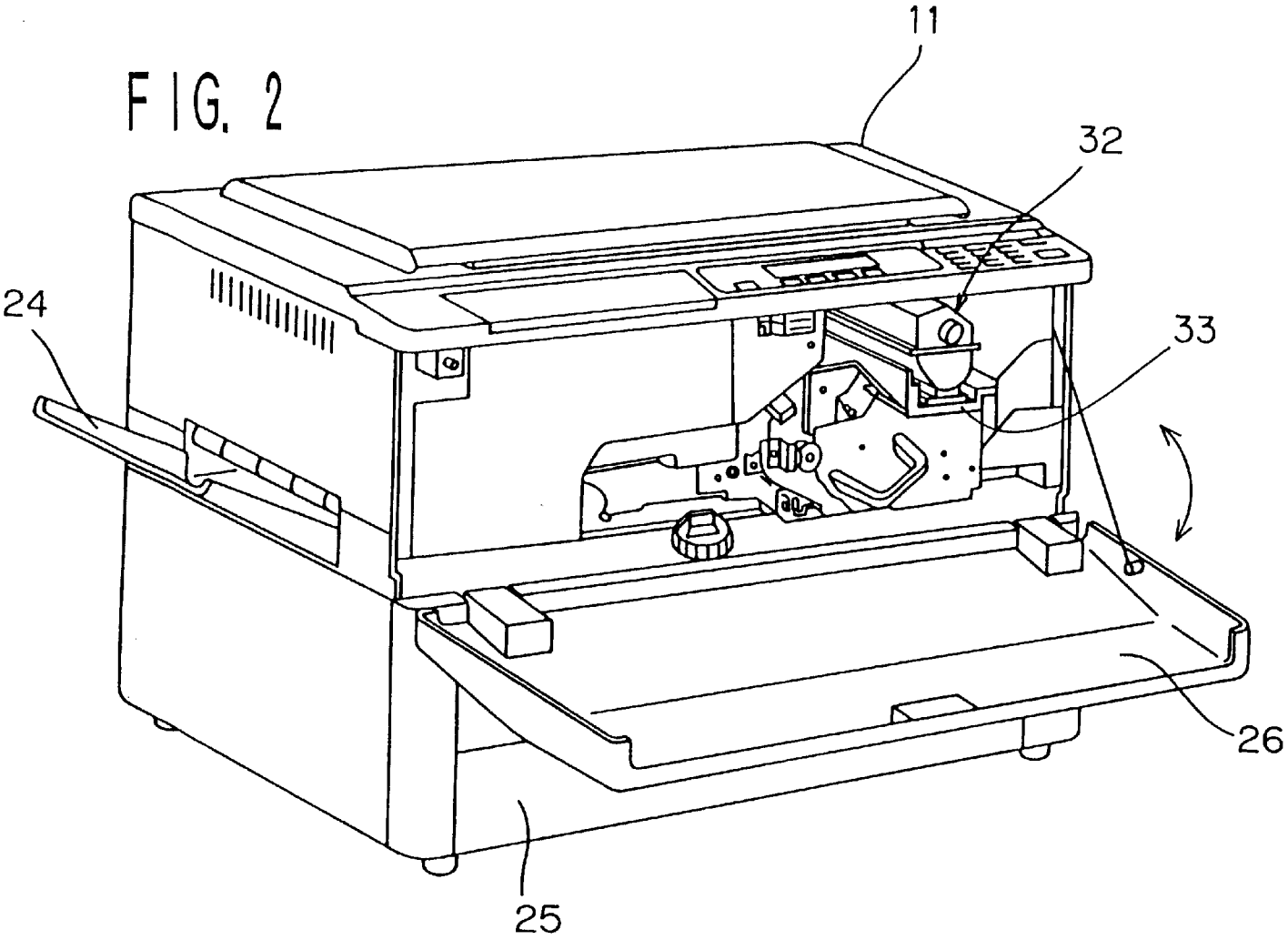
FIG. 2 is a perspective view illustrating the copying machine in a state where the toner supply cartridge is to be inserted therein or removed therefrom.

FIG. 1 is a sectional view schematically illustrating the internal construction of a copying machine in which a toner supply cartridge according to one embodiment of the present invention is set. FIG. 2 is a perspective view illustrating the copying machine in a state where the toner supply cartridge is to be inserted therein or removed therefrom. Although this embodiment is directed to a case where the toner supply cartridge is set in the copying machine, the toner supply cartridge can be applied not only to the copying machine but also to any other image forming apparatuses such as a facsimile machine and a printer.

Referring to FIG. 1, the copying machine includes an optical system 12 for illuminating a document original for scanning thereof, an image formation system 13 for forming a toner image on a sheet, and a sheet transportation system 14 for conveying a sheet from a sheet tray 22 to a sheet discharge tray 24 through the image formation system 13 and a fixing unit 23, which are all provided in a copying machine body 11 thereof. A transparent document original placing plate 15 on which a document original (not shown) is placed is fitted on a top face of the copying machine body 11, and a document original cover 16 for pressing the document original against the document original placing plate 15 is provided above the document original placing plate 15. The optical system 12 is provided below the document original placing plate 15.

The image formation system 13 is disposed below the optical system 12, and has a photoreceptor drum 17. A main charger 18, a developer unit 19, a transfer charger 20 and a cleaning unit 21 are provided around the photoreceptor 17 in this order along the direction of rotation of the photoreceptor 17. The photoreceptor 17 is driven for rotation in synchronization with the scanning of the document original by the optical system 12 and, after being uniformly charged by the main charger 18, exposed to illumination from the optical system 12. Thus, an electrostatic latent image is formed on the surface of the photoreceptor 17. The electrostatic latent image is developed into a toner image by the developer unit 19. The toner image is transferred onto a sheet (not shown) supplied from the sheet tray 22. Then, the transferred toner image is thermally fixed on the sheet by the fixing unit 23. The sheet carrying the toner image fixed thereon is discharged into the discharge tray 24. Toner remaining on the surface of the photoreceptor 17 after the image transfer is recovered by the cleaning unit 21.

In this embodiment, a toner supply cartridge 32 for supplying toner to a hopper 31 in the developer unit 19 is set in the copying machine body 11, and a guide 33 is provided, for example, on an upper face of the hopper 31 for guiding the toner supply cartridge 32 for insertion and withdrawal thereof. When the toner in the hopper 31 is almost run out, the used toner supply cartridge is removed and a new toner supply cartridge 32 filled with toner is set on the hopper 31 to supply the toner into the hopper 31.

Referring to FIG. 2, an openable cover 26 constituting part of a front face 25 of the copying machine body 11 is opened and the used toner supply cartridge is withdrawn from the copying machine body 11 for replacement of the toner supply cartridge 32. In turn, the new toner supply cartridge 32 is guided by the guide 33 to be inserted into the copying machine body 11. Then, the openable cover 26 is lifted up and closed. Thus, the replacement of the toner supply cartridge 32 is completed.

Figure 3:
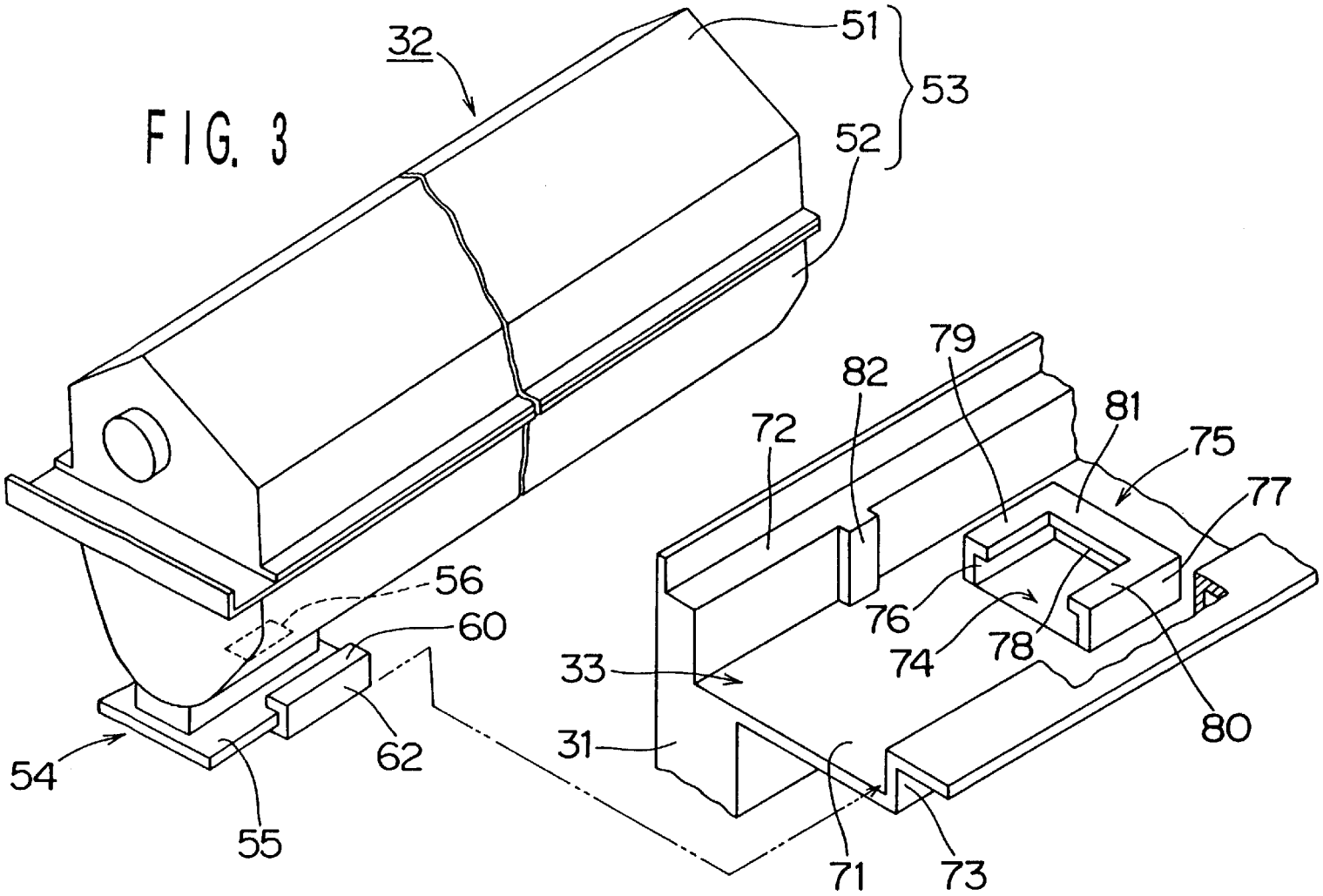
FIG. 3 is a perspective view illustrating the construction of the toner supply cartridge and the construction of a guide.
Figure 4:
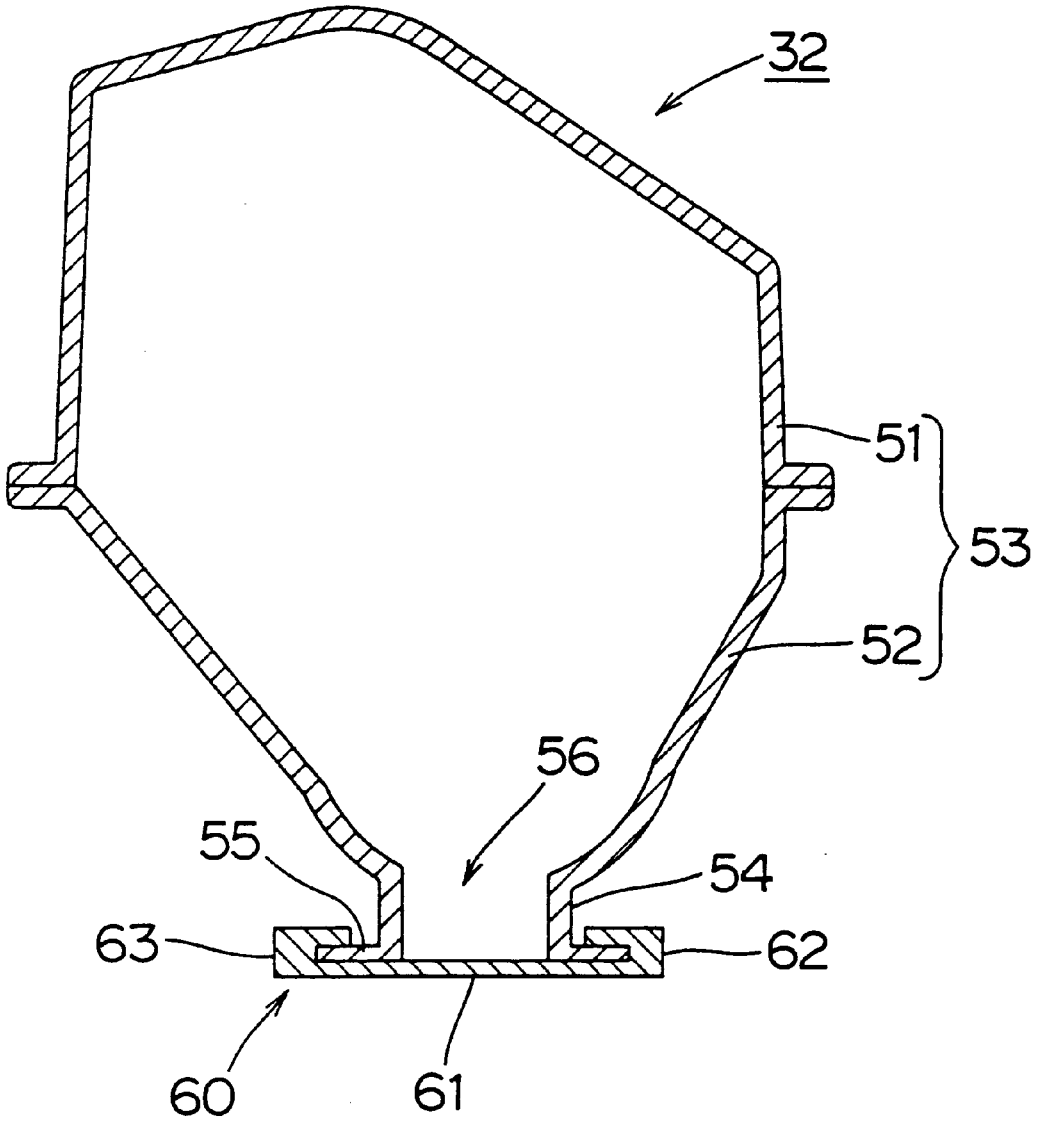
FIG. 4 is a sectional view taken along a line perpendicular to the length of the toner supply cartridge.

FIG. 3 is a perspective view illustrating the construction of the toner supply cartridge 32 and the construction of the guide 33. FIG. 4 is a sectional view taken along a line perpendicular to the length of the toner supply cartridge 32.

Referring to FIGS. 3 and 4, the toner supply cartridge 32 will first be explained. The toner supply cartridge 32 has an elongate cartridge body 53 including an upper case 51 and a lower case 52, and the cartridge body 53 contains therein toner to be supplied. The cartridge body 53 has a connector portion 54 provided in an under face thereof adjacent to one end thereof and formed with a toner fall aperture 56 communicating between the inside and outside of the cartridge body 53. It is noted that the cartridge body 53 may be constructed such that the upper case 51 and the lower case 52 are integrally formed.

On lower edges of the connector portion 54 is provided a flange 55 projecting horizontally from the periphery of the connector portion 54. A shutter 60 for slidably opening and closing the toner fall aperture 56 is attached to the flange 55. When the shutter 60 is slid to open the toner fall aperture 56, the toner in the cartridge body 53 falls through the toner fall aperture 56.

Further, a toner convey spiral (not shown) is provided in the cartridge body 53. The toner generally has a poor fluidity so that the toner inside the cartridge body 53 cannot smoothly be led to the toner fall aperture 56 formed adjacent to the one end of the cartridge body 53. This is why the toner convey spiral is provided. The toner convey spiral is driven for rotation to forcibly convey the toner toward the toner fall aperture 56 in the cartridge body 53. This ensures that all the toner in the cartridge body 53 falls through the toner fall aperture 56.

Figure 5:
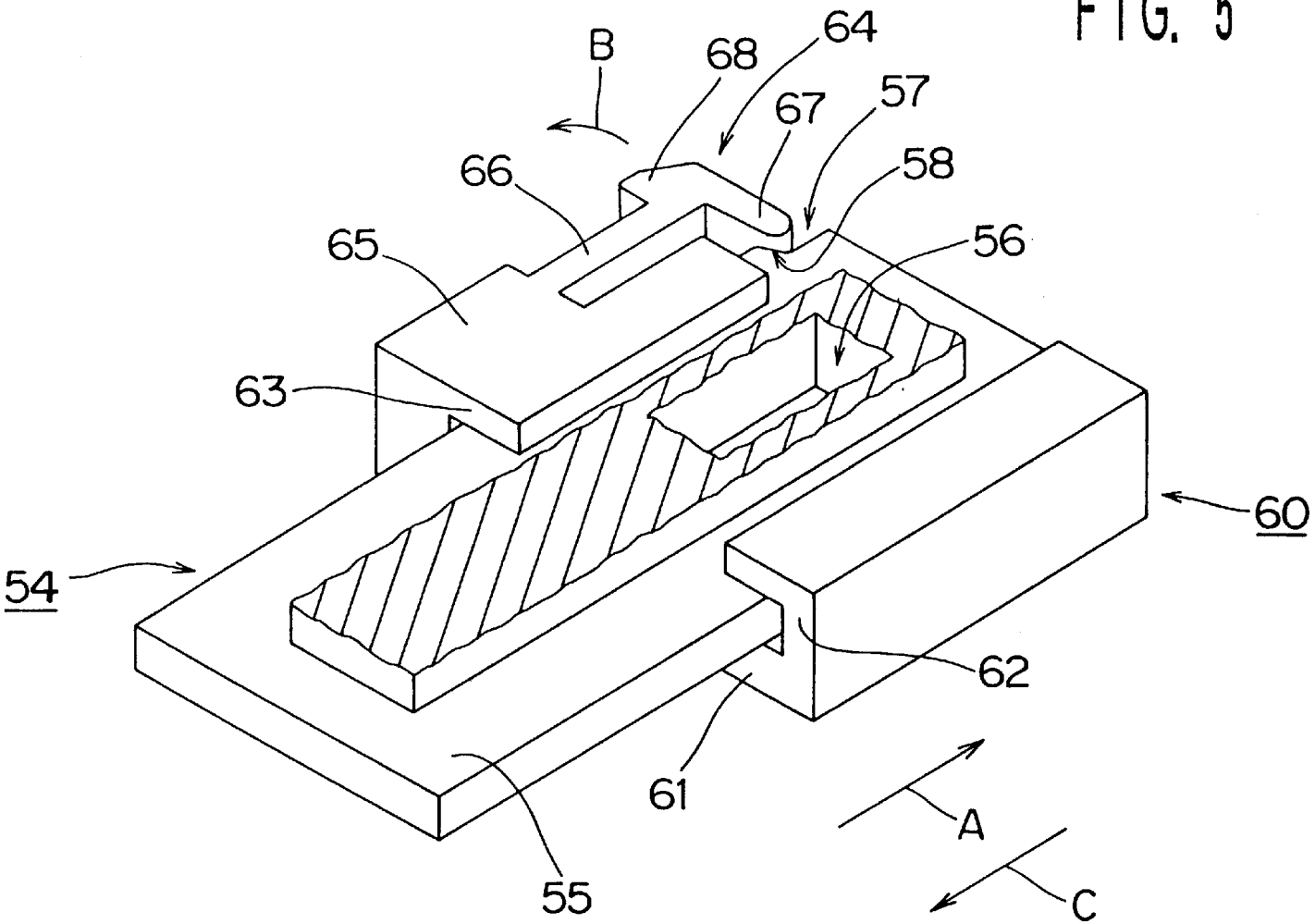
FIG. 5 is an enlarged perspective view illustrating a shutter attached to a flange.

FIG. 5 is an enlarged perspective view illustrating the shutter 60 attached to the flange 55. FIG. 5 shows a state where the toner fall aperture 56 is closed with the shutter 60.

Referring to FIG. 5, an explanation will be given to the shutter 60.

Figure 6:
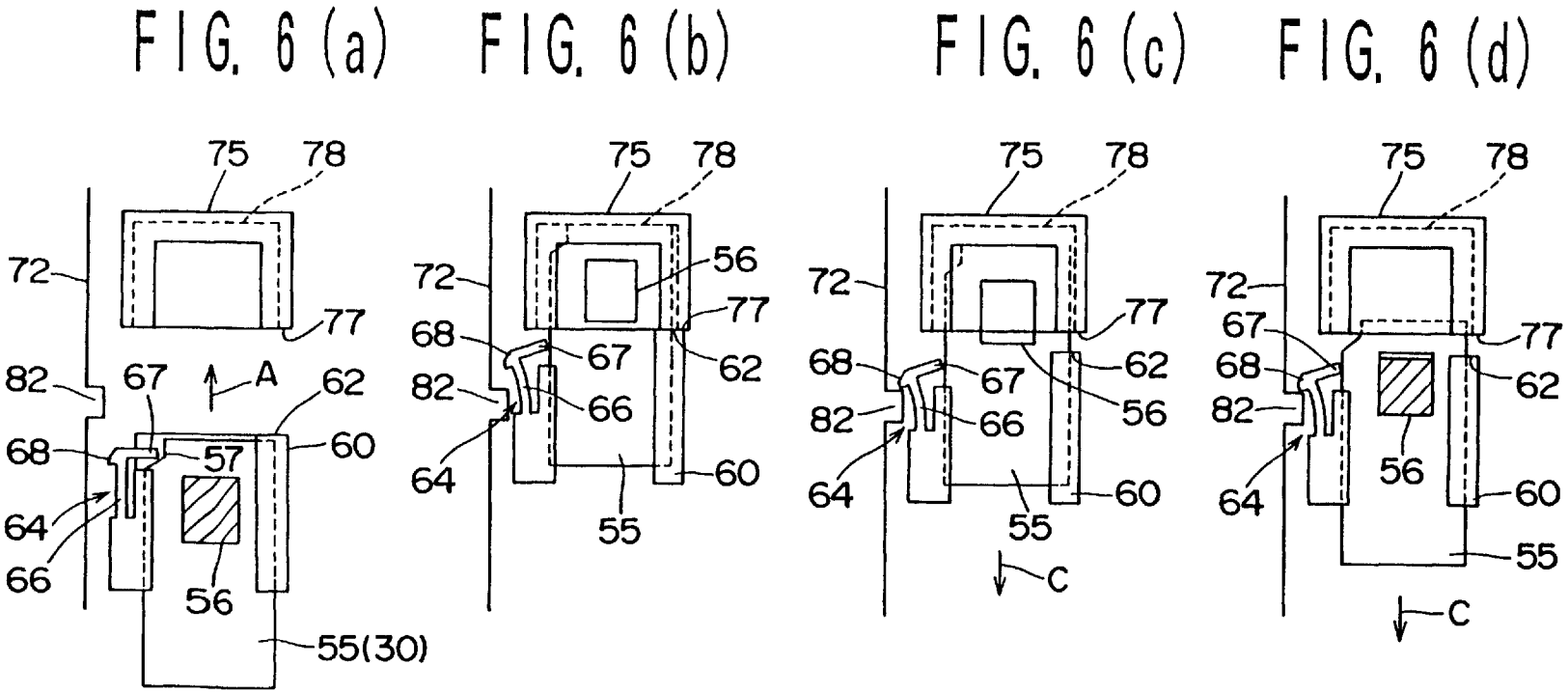
FIGS. 6(*a*) to 6(*d*) are schematic diagrams illustrating a process of the shift of the shutter and the like when the toner supply cartridge is replaced.

The shutter 60 is slid with respect to the flange 55 so as to be shifted between a closed position where the toner fall aperture 56 is closed as shown in FIG. 5 and an open position where the toner fall aperture 56 is open (see FIG. 6(*b*)). The shutter 60 includes a plate portion 61 facing opposite to an under face of the flange 55, a right holding portion 62 having an inverted-L-shaped cross section and extending upwardly of a right edge of the plate portion 61 with respect to a direction A of insertion of the toner cartridge 32, and a left holding portion 63 having an inverted-L-shaped cross section and extending upwardly of a left edge of the plate portion 61. The length of the left holding portion 63 is smaller than the length of the plate portion 61 as measured along the arrow A, so that a claw 64 which will be described later is not brought in contact with the left holding portion 63. The shutter 60 is attached to the flange 55 in such a manner that the right and left edges of the flange 55 are held between the plate portion 61 and the right holding portion 62 and between the plate portion 61 and the left holding portion 63, respectively.

The shutter 60 includes the claw 64 provided on a side of the left holding portion 63 and adapted to be locked to a return portion 82 (to be described later) when the toner supply cartridge 32 is removed from the copying machine body 11. The shutter 60 and the claw 64 may integrally be formed of a resin. The claw 64 includes a stationary portion 65 fixed to the left holding portion 63, a resilient deformable portion 66 extending in the direction of the arrow A from the stationary portion 65, a guided portion 67 extending from an end of the deformable portion 66 toward the flange 55 (to the right with respect to the arrow A), and a lock portion 68 extending outwardly of the end of the deformable portion 66 (to the left with respect to the arrow A).

A cut-away portion 57 is formed in a left end portion of the flange 55 with respect to the direction of the arrow A. When the shutter 60 is located in the closed position as shown in FIG. 5, the tip of the guided portion 67 of the claw 64 is fitted in the cut-away portion 57 so that the deformable portion 66 of the claw 64 is not deformed. When the shutter 60 is slid from the closed position along the flange 55 in the direction of the arrow C, the tip of the guided portion 67 is guided away from the cut-away portion 57 by a guide face 58 of the cut-away portion 57, and abuts against a left side face of the flange 55. At this time, the deformable portion 66 of the claw 64 is bent to the direction of the arrow B, so that the lock portion 68 of the claw 64 projects outward.

Referring again to FIG. 3, an explanation will next be given to the guide 33 for guiding the toner supply cartridge 32 for insertion and withdrawal thereof.

The guide 33 is formed, for example, on an upper face of the hopper 31. The guide 33 includes a bottom face 71 doubling as the upper face of the hopper 31, and a pair of side walls 72 and 73 extending upright from opposite edges of the bottom face 71 along the direction of insertion of the toner supply cartridge 32 (indicated by a two-dot-and-dash line in FIG. 3). The toner supply cartridge 32 is inserted into or withdrawn from the copying machine body along the bottom face 71 with its movement in a direction perpendicular to the insertion direction restricted by the side walls 72 and 73.

A supply aperture 74 for supplying the toner into the hopper 31 is formed in a predetermined position of the bottom face 71. The supply aperture 74 is, for example, rectangular in shape. Provided in association with the supply aperture 74 is an engagement portion 75 to be brought in engagement with the flange 55 of the connector portion 54 when the toner supply cartridge 32 is set.

The engagement portion 75 includes engagement side walls 76 and 77 extending upright from left and right side edges of the supply aperture 74 with respect to the direction of the insertion of the toner supply cartridge 32, a flange restricting portion 78 extending upright from a downstream edge of the supply aperture 74, and placing portions 79, 80 and 81 respectively extending horizontally inwardly of upper edges of the engagement side walls 76 and 77 and the flange restricting portion 78.

A return portion 82 of a linear projection extending across the height of the side wall 72 is formed in a predetermined position on the left side wall 72 with respect to the direction of the insertion of the toner supply cartridge 32. When the toner supply cartridge 32 is withdrawn, the return portion 82 locks the lock portion 68 of the claw 64 provided on the shutter 60, thereby prohibiting the shutter 60 from moving in a direction opposite to the direction of the insertion of the toner supply cartridge 32.

FIGS. 6(*a*) to 6(*d*) are schematic diagrams illustrating a process of the shift of the shutter 60 and the like, as viewed from the top of the shutter 60, when the toner supply cartridge 32 is replaced. Referring to FIGS. 5 and 6(*a*) to 6(*d*), the insertion and withdrawal of the toner supply cartridge 32 will be described in greater detail. In FIGS. 6(*a*) to 6(*d*), the toner fall aperture 56 is closed with the shutter 60 if the toner fall aperture 56 is illustrated with hatch and, conversely, the toner fall aperture 56 is open if the toner fall aperture 56 is illustrated without hatch.

For the setting of the new toner supply cartridge 32, the toner supply cartridge 32 is guided by the guide 33 to be inserted in the direction of the arrow A. At this time, the shutter 60 is located in the position where the toner fall aperture 56 is closed and, hence, the tip of the guided portion 67 of the claw 64 is fitted in the cut-away portion 57 of the flange 55 so that the lock portion 68 of the claw 64 does not project outward (see FIG. 6(*a*)). Therefore, the lock portion 68 is unlocked by the return portion 82 formed on the side wall 72 when the toner supply cartridge 32 is inserted.

As the toner supply cartridge 32 is inserted, the right holding portion 62 of the shutter 60 abuts against the engagement side wall 77 of the engagement portion 75, and only the flange 55 is introduced into a space defined by the engagement portion 75 with the shutter 60 prohibited from moving in the insertion direction as shown in FIG. 6(*b*). More specifically, the engagement side wall 77 prohibits the shutter 60 from moving in the insertion direction (the direction of the arrow A) when the toner supply cartridge 32 is set. Thus, the shutter 60 is slid in the direction opposite to the insertion direction with respect to the flange 55, thereby opening the toner fall aperture 56.

As the shutter 60 is slid in the direction opposite to the insertion direction with respect to the flange 55, the tip of the guided portion 67 of the claw 64 is guided away from the cut-away portion 57 by the guide face 58 of the cut-away portion 57 to abut against the left side wall of the flange 55. At this time, the deformable portion 66 of the claw 64 is bent, so that the lock portion 68 of the claw 64 projects leftward as shown in FIG. 6(*b*). The setting of the toner supply cartridge 32 is completed in such a state that the leading end face of the flange 55 introduced into the space defined by the engagement portion 75 abuts against the flange restricting portion 78 of the engagement portion 75. With the toner supply cartridge 32 thus set, a rearward portion of the lower case 52 of the toner supply cartridge 32 is placed on the placing portions 79, 80 and 81, and the toner fall aperture 56 is located above the supply aperture 74 (see FIG. 3) formed in the upper face of the hopper 31. Therefore, the toner in the cartridge body 53 falls into the supply aperture 74 through the opened toner fall aperture 56 thereby to be supplied into the hopper 31.

The setting of the toner supply cartridge 32 is achieved simply by thus inserting the toner supply cartridge 32 along the guide 33 formed on the upper face of the hopper 31 (see FIG. 3) in the direction of the arrow A, whereby the shutter 60 is automatically opened and the toner is supplied from the toner supply cartridge 32 into the hopper 31. Therefore, the replacement of the toner supply cartridge is facilitated in comparison with a conventional case which requires a two-step procedure including the steps of setting a toner supply cartridge in the copying machine body and then sliding a shutter to open a toner fall aperture. Since the shutter 60 is automatically opened, even a user unfamiliar with the replacement of the toner supply cartridge will not forget to open the shutter 60 nor make a like cartridge setting failure.

Referring to FIG. 6(*c*), when the toner in the cartridge body 53 of the toner supply cartridge 32 is used up, the toner supply cartridge 32 is withdrawn along the guide 33. As shown in FIG. 6(*c*), the lock portion 68 of the claw 64 projecting leftward is locked to the return portion 82 formed on the side wall 72 thereby to prohibit the shutter 60 from moving in the direction opposite to the insertion direction.

When the toner supply cartridge 32 is further moved in the direction opposite to the insertion direction (the direction of the arrow C) in this state, only the flange 55 is moved in the direction opposite to the insertion direction. Therefore, the shutter 60 is slid in the insertion direction with respect to the flange 55 so that the toner fall aperture 56 is closed with the shutter 60 (see FIG. 6(*d*)). Then, the tip of the guided portion 67 of the claw 64 is moved along the left side face of the flange 55, and fitted into the cut-away portion 57 of the flange 55. Thus, the deformable portion 66 of the claw 64 becomes unbent and is restored to the state shown in FIG. 6(*a*), so that the lock portion 68 is disengaged from the return portion 82. More specifically, when the toner fall aperture 56 is closed with the shutter 60, the lock portion 68 is disengaged from the return portion 82, thereby permitting the toner supply cartridge 32 to be withdrawn.

This arrangement obviates the need to intentionally close the toner fall aperture by sliding the shutter, so that a user will not fail to close the toner fall aperture.

While there has been illustrated and described what is at present considered to be a preferred embodiment of the present invention, it will be understood by those skilled in the art that various changes and modifications may be made, and equivalents may be substituted for elements thereof without departing from the true scope of the invention. It is intended that this invention not be limited to the particular embodiment disclosed as the best mode contemplated for carrying out the invention, but that the invention will include all embodiments falling within the scope of the appended claims.

What is claimed is:

1. A toner cartridge which is adapted to be guided for sliding by a guide provided in a toner supplying apparatus so as to be set in a predetermined set position in the toner supplying apparatus, said toner cartridge comprising:

a container containing toner therein and having a toner fall aperture formed in an under face thereof; and a shutter disposed in association with the toner fall aperture and adapted to be slidably shifted between a closed position where the toner fall aperture is closed and an open position where the toner fall aperture is opened;

wherein the shutter has a first portion which is locked by a stopper provided on the guide so that the shutter is shifted from the closed position to the open position when the toner cartridge is to be set in position and a second portion which is locked by a returner provided on the guide so that the shutter is shifted from the open position to the closed position when the toner cartridge is removed;

wherein a flange is provided around the toner fall aperture to project horizontally therefrom;

wherein the shutter is provided slidably with respect to the flange; and wherein the second part of the shutter has a claw, the flange is formed with a cut-away portion, and one part of the claw is fitted in the cut-away portion and another part of the claw is in an unlockable state when the shutter is located in the closed position.

2. A toner cartridge as set forth in claim 1, wherein the one part of the claw is guided away from the cut-away portion to a side face of the flange and the another part of the claw is in the lockable state when the shutter is located in the open position.

3. A toner cartridge as set forth in claim 2, wherein the claw is formed of a resin integrally with the shutter.

4. A toner supplying apparatus for adapting an image forming apparatus, said toner supplying apparatus comprising:

a toner cartridge containing toner therein and having a toner fall aperture formed in an under face thereof; and a guide for guiding the toner cartridge to a predetermined set position when the toner cartridge slides in a predetermined insertion direction;

wherein the toner cartridge has a shutter disposed in association with the toner fall aperture, the shutter being slidably shiftable between a closed position where the toner fall aperture is closed and an open position where the toner fall aperture is opened;

wherein the guide has a stopper for locking a first portion of the shutter and shifting the shutter from the closed position to the open position when the toner cartridge slides to the set position, and a returner for locking a second portion of the shutter and shifting the shutter from the open position to the closed position when the toner cartridge slides for removal thereof; and wherein the second portion of the shutter has a claw which, when the toner cartridge is to be set in position, is unlocked by the returner and, when the toner cartridge is to be removed, projects perpendicularly with respect to the toner cartridge insertion direction while the shutter is being shifted to the open position so as to be locked by the returner.

5. A toner supplying apparatus as set forth in claim 4, wherein a flange is provided around the toner fall aperture to project horizontally therefrom, and wherein the shutter is provided slidably with respect to the flange.

6. A toner supplying apparatus as set forth in claim 5, wherein the flange is formed with a cut-away portion, and one part of the claw is fitted in the cut-away portion.

7. A toner supplying apparatus as set forth in claim 6, wherein the one part of the claw is guided away from the cut-away portion to a side face of the flange and the other part of the claw is in a lockable state when the shutter is located in the open position.

8. A toner supplying apparatus as set forth in claim 7, wherein the claw is formed of a resin integrally with the shutter.

* * * * *